US009022307B2

(12) United States Patent
Kakuda et al.

(10) Patent No.: US 9,022,307 B2
(45) Date of Patent: May 5, 2015

(54) PULVERIZER

(71) Applicants: Shigeaki Kakuda, Shizuoka (JP); Nobuyasu Makino, Shizuoka (JP)

(72) Inventors: Shigeaki Kakuda, Shizuoka (JP); Nobuyasu Makino, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 137 days.

(21) Appl. No.: 13/792,988

(22) Filed: Mar. 11, 2013

(65) Prior Publication Data

US 2013/0248628 A1 Sep. 26, 2013

(30) Foreign Application Priority Data

Mar. 21, 2012 (JP) ..... 2012-063377

(51) Int. Cl.
*B02C 19/06* (2006.01)
*B02C 19/00* (2006.01)

(52) U.S. Cl.
CPC ..... *B02C 19/0043* (2013.01); *B02C 19/066* (2013.01)

(58) Field of Classification Search
CPC ..... B02C 19/06; B02C 19/066
USPC ..... 241/5, 39, 40
See application file for complete search history.

(56) References Cited

U.S. PATENT DOCUMENTS

| | | | | |
|---|---|---|---|---|
| 5,765,766 | A * | 6/1998 | Yoshida et al. | 241/39 |
| 2001/0010888 | A1 | 8/2001 | Izu et al. | |
| 2003/0178514 | A1 | 9/2003 | Makino et al. | |
| 2010/0170966 | A1 | 7/2010 | Makino | |
| 2012/0228414 | A1 | 9/2012 | Makino et al. | |

FOREIGN PATENT DOCUMENTS

| | | |
|---|---|---|
| JP | 3-086257 | 4/1991 |
| JP | 4-326952 | 11/1992 |
| JP | 7-060150 | 3/1995 |
| JP | 7-136543 | 5/1995 |
| JP | 8-052376 | 2/1996 |
| JP | 2000-140675 | 5/2000 |
| JP | 2010-155224 | 7/2010 |

* cited by examiner

*Primary Examiner* — Mark Rosenbaum
(74) *Attorney, Agent, or Firm* — Oblon, McClelland, Maier & Neustadt, L.L.P.

(57) ABSTRACT

The pulverizer including a pulverization chamber, a jet nozzle, a pulverization nozzle, and a collision member is provided. The pulverization nozzle includes an acceleration tube. The acceleration tube includes an acceleration part A and an acceleration part B. A center (a) of the supply aperture is positioned within the acceleration part A. A point of intersection (b) where central axes of the acceleration tube and the supply aperture intersect is positioned within the acceleration part B. An angle θ formed between the central axes of the acceleration tube and the supply aperture satisfies an inequation $30° \leq \theta < 60°$.

7 Claims, 6 Drawing Sheets

PULVERIZER

CROSS-REFERENCE TO RELATED APPLICATIONS

This patent application is based on and claims priority pursuant to 35 U.S.C. §119 to Japanese Patent Application No. 2012-063377, filed on Mar. 21, 2012, in the Japan Patent Office, the entire disclosure of which is hereby incorporated by reference herein.

BACKGROUND

1. Technical Field

The present disclosure relates to a pulverizer.

2. Description of Related Art

In image forming methods such as electrophotography and electrostatic photography, visible images are formed by developing electrostatic latent images with toner. Toner is comprised of fine particles. Fine particles of toner are generally produced by melting and kneading raw materials of the toner, such as binder resins and colorants (e.g., dyes, pigments, magnetic materials), cooling and solidifying the kneaded product, pulverizing the solidified product, and classifying the pulverized product by size. In the above processes of pulverizing and classifying, a collision-type airflow pulverization-classification apparatus, such as an impact dispersion separator illustrated in FIG. 4A, can be used. In this apparatus, a pulverization object is accelerated by a jet flow and brought into collision with a collision plate to be pulverized. The pulverization product is then classified by size with a swirling airflow.

In a collision-type airflow pulverization-classification apparatus 107 illustrated in FIG. 4A, a powdery material is supplied from an input opening 102*a* and dispersed within a dispersion chamber 102. The powdery material is then anti-freely fluidized on a swirling airflow within a classification chamber 102*c* by the action of a secondary airflow 102*b* injected into the classification chamber 102*c*. The powdery material is classified into coarse particles and fine particles by the actions of the centrifugal and centripetal forces therein.

The fine particles are sent to a next process. The coarse particles fall down by their own weight to a returning chamber 108 and flow into a pulverizer 109 through a casing hopper 103.

In the pulverizer 109, the coarse particles 110 are sucked from a supply aperture 104, accelerated in an acceleration tube 114 of a pulverization nozzle 105, and brought into collision with a collision member 106 ahead to be pulverized. The pulverization product then goes up from a pulverization chamber 111 and flows into the dispersion chamber 102 again together with a newly-input powdery material input from an inlet opening 101, resulting in formation of a closed circuit pulverization.

One end of the acceleration tube 114 is connected to a jet nozzle 112 that supplies compressed air. The other end, i.e., an exit 115, of the acceleration tube 114 is facing the collision member 106. The coarse particles 110 are sucked from a supply opening 116 into the acceleration tube 114 by the flux of a high-speed airflow 113 that is a jet flow. The coarse particles are then conveyed to the pulverization chamber 111 by the injection of the high-speed airflow 113 and brought into collision with a collision surface 117 of the collision member 106 to be pulverized by the collision force.

Recently, image forming apparatuses have been improved in terms of image quality and colorization. In accordance with such improvements, there is a demand for a toner having a smaller particle size and a lower melting point. However, there are concerns that the production efficiency of such a toner is lowered in a case in which the toner is produced by an airflow-type pulverization-classification apparatus and the raw materials are fixedly adhered to such a production apparatus. These concerns also arise when the high-speed airflow 113 (i.e., jet flow) is neither sufficient nor uniform and therefore the pulverization object is dispersed within the acceleration tube 114 neither sufficiently nor uniformly.

JP-H08-052376-A (corresponding to JP-3219955-B2) discloses a collision-type airflow pulverizer illustrated in FIG. 4B. This apparatus is configured to satisfy the following inequation: $L \tan(\theta/2) \geq L1 \tan(\theta 1/2) > (1/2) L \tan(\theta/2)$, wherein L represents the effective length of an acceleration tube 114, L1 represents ½ of the length L from the throat part along their common central line, θ represents the spread angle of the acceleration tube 114, θ1 represents twice of the angle formed between the common central line and a line connecting the throat part and one point on the inner peripheral surface of the acceleration tube 114 where the length from the throat point is L1.

JP-2010-155224-A discloses an airflow-type pulverization-classification apparatus illustrated in FIG. 5. The apparatus illustrated in FIG. 5 includes a jet nozzle 112 that injects a jet flow 113 in a pulverization chamber 111; a pulverization nozzle 105 having an acceleration tube 114, one end of which is connected to the front end of the jet nozzle 112 and the other end is opened to the pulverization chamber 111, and a supply tube 115 opened to the acceleration tube 114 to supply a pulverization object 110 to the jet flow 113; and a collision member 106 having a pulverization surface 117 disposed facing the jet nozzle 112. The pulverization object 110 along with the jet flow 113 is brought into direct collision with the pulverization surface 117 to be finely pulverized. A pressure gauge P is provided above the point where the supply tube 115 joins the acceleration tube 114. The pressure gauge P manages the supply condition of the pulverization object 110 to the acceleration tube 114.

JP-3016402-B2 (corresponding to JP-H04-326952-A) discloses a collision-type airflow pulverizer having an acceleration tube and a collision member. The acceleration tube is in the form of a de Laval nozzle provided with an inlet for high-pressure gas upstream from the throat part. A high-pressure gas introduced into the acceleration tube from the inlet conveys and accelerates a raw material. The collision member has a collision surface disposed facing the exit of the acceleration tube. The raw material is brought into collision with the collision member to be pulverized by the collision force. The collision surface has a cone-shaped tip whose apex angle is between 110 and 175 degrees.

JP-3114040-B2 (corresponding to JP-H07-60150-A) discloses a collision-type airflow pulverizer illustrated in FIG. 6. The apparatus illustrated in FIG. 6 includes an acceleration tube 201 that conveys and accelerates a pulverization object supplied through a high-pressure gas supply nozzle 203; and a pulverization chamber 213 within which the pulverization object is finely pulverized. Within the pulverization chamber 213, a collision member 211 having a collision surface is disposed with the collision surface facing an exit opening 210 of the acceleration tube 201. On the rear end of the acceleration tube 201, a pulverization object supply aperture is provided. The collision surface has a protruded central part 216 and an outer peripheral collision surface 217 having a cone shape. The pulverization chamber 213 has a side wall 215. The pulverization object having been pulverized by the collision member 211 is further brought into collision with the side wall 215 to be further pulverized. The apparatus satisfies the following inequation: $2(L1+L3)/3<L2<3\cdot L3$, wherein $L1(\geq 0)$ represents the length of the high-pressure gas supply nozzle 203 having a throat diameter of $a(>0)$, $L2(>0)$ represents the length of the acceleration tube 201, and $L3(>0)$ represents the shortest distance between the apex of the protruded central part 216 and the outer peripheral collision surface 217. The apparatus further satisfies the following inequations: $0°\leq\theta1\leq 20°$ and $a+2\cdot L1\tan(\theta1/2)<b<c/2$, wherein $\theta1$ represents the spread angle of the high-pressure gas supply nozzle 203, b represents the throat diameter of the acceleration tube 201, and c represents the diameter of the bottom surface of the protruded central part 216. The apparatus further satisfies the following inequations: $0°\leq\theta2\leq 20°$ and $b+2\cdot L2\tan(\theta2/2)<c<d$, wherein $\theta2$ represents the spread angle of the acceleration tube 201 and d represents the diameter of the outer peripheral collision surface 217. The apparatus further satisfies the following inequations: $0°<\theta3<90°$, $0°<\theta03<\theta4<90°$, and $d+2\cdot L3\tan(\theta3/2)>e>d$, wherein $\theta3$ represents the apex angle of the protruded central part 216, $\theta4$ represents the apex angle of the outer peripheral collision surface 217, e represents the diameter of the pulverization chamber 213, and $c=2\cdot L3\tan(\theta3/2)$.

JP-3219918-B2 (corresponding to JP-H07-136543-A) discloses a pulverizer including a jet nozzle that injects a jet flow in a pulverization chamber; an acceleration tube, one end of which is connected to the front end of the jet nozzle and the other end is opened to the pulverization chamber; a supply tube opened to the acceleration tube to supply a pulverization object to the jet flow; and a collision member having a pulverization surface disposed facing the jet nozzle. The pulverization object along with the jet flow is brought into direct collision with the pulverization surface to be finely pulverized. The supply tube has an introduction part vertical to the acceleration tube; and an injection part, one end of which is connected to the introduction part and the other end is opened to the acceleration tube, slanted in the direction of the jet flow. The injection part includes a first air supply opening opened to the injection part; a first air supply means for supplying the air to the injection part through the first air supply opening; a second air supply opening opened to the injection part; and a second air supply means for supplying the air to the injection part through the second air supply opening. The central axis of the second air supply opening is parallel to that of the injection part.

JP-H03-086257-A discloses a collision-type airflow pulverizer including an acceleration tube that conveys and accelerates a powder material by a high-pressure gas; a pulverization chamber; and a collision member that pulverizes the powder material injected from the acceleration tube by a collision force. The collision member is provided within the pulverization chamber with facing the exit of the acceleration tube. The acceleration tube is provided with a powder material inlet. A secondary air inlet is provided between the powder material inlet and the exit of the acceleration tube. This apparatus satisfies the following inequations: $0.2\leq y/x\leq 0.9$ and $10°\leq\Psi\leq 80°$, wherein x represents the distance between the powder material inlet and the exit of the acceleration tube, y represents the distance between the raw material inlet and the secondary air inlet, $\Psi$ represents the installation angle of the secondary air inlet to the acceleration tube in the axial direction of the acceleration tube.

JP-2000-140675-A discloses pulverizers illustrated in FIGS. 7A to 7D. A compressed gas is supplied to an acceleration nozzle 312 through an inlet 313, throttled at a throat part 314 provided downstream from the inlet 313, and expanded at a diffuser part 315 provided downstream from the throat part 314 to form a jet current. A pulverization object is supplied to the acceleration nozzle 312 from a pulverization object supply opening 317 of a hopper 309. The pulverization object is injected from the exit of the acceleration nozzle 312 and brought into collision with a collision member 304, facing the exit, to be pulverized. The inner surface of the throat part 314 is contiguous with those of the inlet 313 and the diffuser part 315, forming a smooth arc-like inner surface. A straight part 316 is further provided at an exit side of the diffuser part 315. The cross-sectional area of the straight part 316 in the axial direction is constant over the entire length thereof. According to one example, L1=55 mm, L2=238 mm, L3=56 mm, D1=70 mm, D2=37 mm, $\theta1=30°$, $\theta2=11°$, and r=33 mm are satisfied.

In the above-described arts, generally, a pulverization object is supplied from a hopper to an acceleration tube through a supply aperture and accelerated by a jet flow in the acceleration tube. The ability of pulverizing pulverization object generally improves when the acceleration speed of the jet flow is kept constant during the supply of pulverization object to the acceleration tube.

In the related arts, the supply aperture is generally connected to the acceleration tube forming a relatively large angle therebetween. This means that the cross-sectional area of the supply aperture is relatively small and therefore the ability of supplying pulverization object to the acceleration tube is relatively low. In a case in which the pulverization object is pulverized into very fine particles, the ability of pulverizing pulverization object is more lowered because the ability of supplying pulverization object is lowered by changes in bulk density of the pulverization object, which may cause clogging of the hopper.

SUMMARY

In accordance with some embodiments, a pulverizer equipped with a pulverization nozzle that injects jet flow is provided. The pulverizer uniformly pulverizes a pulverization object with a high degree of efficiency without lowering the acceleration speed of the jet flow without causing concretion, adhesion, or aggregation of the pulverization product.

The pulverizer includes a pulverization chamber, a jet nozzle, a pulverization nozzle, and a collision member. The jet nozzle is adapted to generate a jet flow toward the pulverization chamber. The pulverization nozzle includes an acceleration tube and a supply aperture. The acceleration tube includes an acceleration part A and an acceleration part B. One end of the acceleration part A is connected to a front end of the jet nozzle, and a cross-sectional area of the acceleration part A is gradually enlarged from said end toward the other end. The cross-sectional area is perpendicular to a central axis of the acceleration tube. One end of the acceleration part B is connected to the acceleration part A and the other end is opened to the pulverization chamber, and the cross-sectional area of the acceleration part B is constant. The supply aperture is opened to the acceleration tube to supply a pulverization object to the jet flow. The collision member is disposed within the pulverization chamber. The collision member has a pulverization surface, and the pulverization surface faces the pulverization nozzle so that the pulverization object conveyed by the jet flow directly collides with the pulverization surface to be finely pulverized. A center (a) of the supply aperture is positioned within the acceleration part A. A point of intersection (b) where central axes of the acceleration tube and the supply aperture intersect is positioned within the acceleration part B. An angle θ formed between the central axes of the acceleration tube and the supply aperture satisfies an inequation $30° \leq \theta < 60°$.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
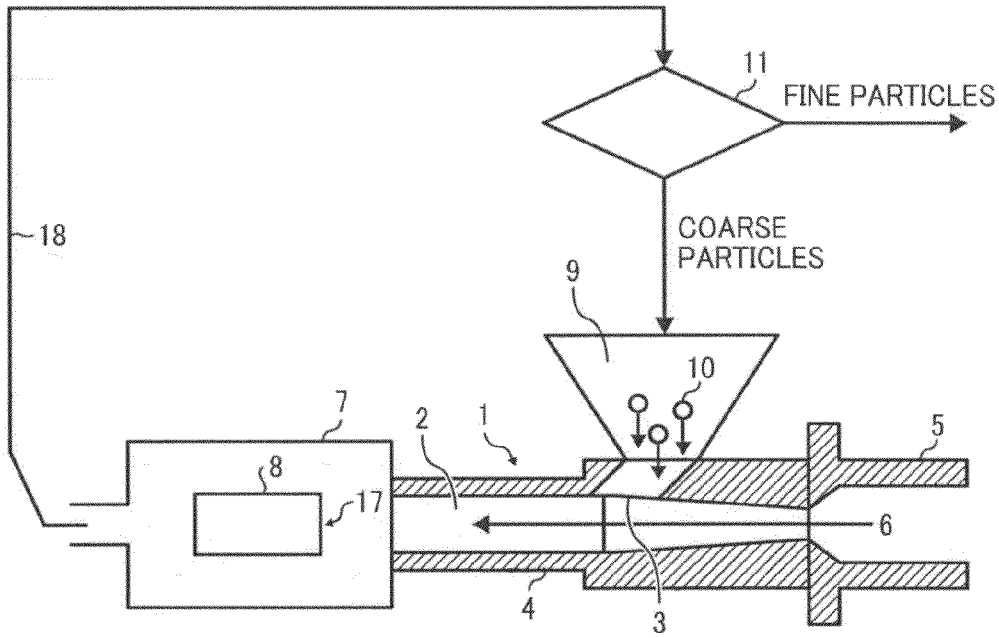
FIG. 1 is a schematic view of a pulverizer according to an embodiment.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

Figure 2:
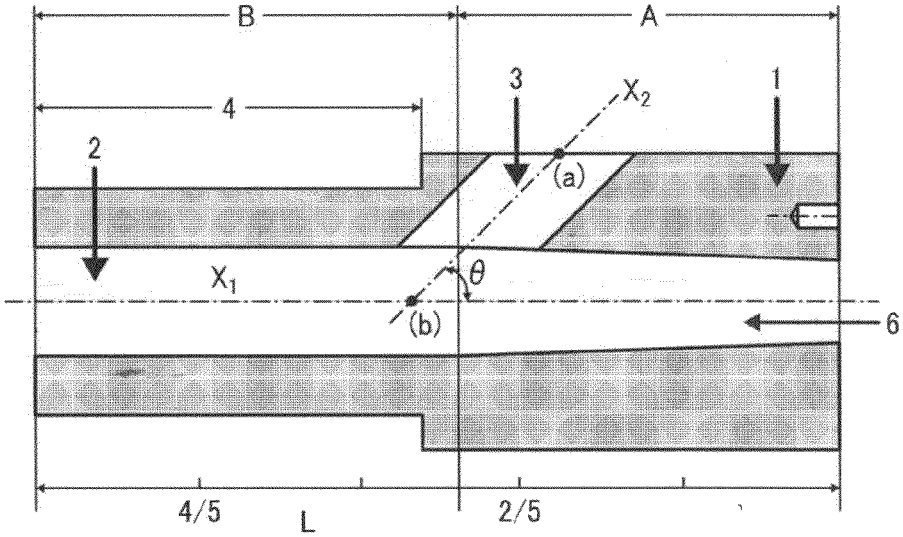
FIG. 2 is a magnified schematic view of a pulverization nozzle illustrated in FIG. 1.

FIG. 1 is a schematic view of a pulverizer according to an embodiment. FIG. 2 is a magnified schematic view of a pulverization nozzle illustrated in FIG. 1.

A pulverizer illustrated in FIG. 1 includes a jet nozzle 5, a pulverization nozzle 1, and a pulverization chamber 7. The jet nozzle 5 injects a jet flow 6 in the pulverization chamber 7. The pulverization nozzle 1 has an acceleration tube 2 and a supply aperture 3. One end of the acceleration tube 2 is connected to the front end of the jet nozzle 5 and the other end is opened to the pulverization chamber 7. The supply aperture 3 is opened to the acceleration tube 2 to supply a pulverization object 9 to the jet flow 6. Within the pulverization chamber 7, a collision member 8 having a pulverization surface 17 is disposed with the pulverization surface 17 facing the jet nozzle 5. The pulverization object 9 along with the jet flow 6 is brought into direct collision with the pulverization surface 17 to be finely pulverized. Referring to FIG. 2, the angle θ formed between the central axis X1 of the acceleration tube 2 and the central axis X2 of the supply aperture 3 satisfies an inequation $30° \leq \theta < 60°$. The point of intersection (b) of the central axes X1 and X2 is positioned between two points at distances of 2/5×L and 4/5×L from the jet-nozzle-5-side end of the pulverization nozzle 1, where L represents the length of the pulverization nozzle 1.

The pulverization object 9 is input from a certain part on a circulation path 18, for example, from a pulverization object hopper 10 in the present embodiment. The pulverization object 9 is then supplied to the pulverization nozzle 1 through the supply aperture 3 that is connected to a lower part of the pulverization object hopper 10. The pulverization object 9 supplied through the supply aperture 3 is accelerated in the acceleration tube 2 and brought into collision with the pulverization surface 17 of the collision member 8 ahead to be pulverized. The pulverization product is introduced into a classifier 11 through the circulation path 18 and is classified into fine particles and coarse particles. The fine particles are collected as a product. The coarse particles are introduced into the pulverization nozzle 1 through the supply aperture 3 again together with a newly-input pulverization object 9.

Referring to FIG. 2, the angle θ formed between the central axis X1 of the pulverization nozzle 1 and the central axis X2 of the supply aperture 3; the point of intersection (b) of the central axes X1 and X2; and the center (a) of the supply aperture 3 are illustrated. The acceleration tube 2 consists of an acceleration part A and an acceleration part B. One end of the acceleration part A is connected to the front end of the jet nozzle 5, and a cross-sectional area of the acceleration part A is gradually enlarged from the front end of the jet nozzle 5 toward the other end. One end of the acceleration part B is connected to the acceleration part A and the other end is opened to the pulverization chamber 7, and a cross-sectional area of the acceleration part B is constant. In other words, the acceleration part B forms a straight tube part parallel to the central axis of the pulverization nozzle 1. Here, the cross-sectional areas refer to those which are perpendicular to the central axis of the acceleration tube 2.

The center (a) of the supply aperture 3 is positioned within the acceleration part A. In some embodiments, the center (a) of the supply aperture 3 is positioned between two points at distances of 1/5×L and 2/5×L from the jet-nozzle-5-side end of the pulverization nozzle 1, where L represents the length of the pulverization nozzle 1.

When the angle θ is less than 30°, the distance of the point of intersection (b) from the jet-nozzle-5-side end of the pulverization nozzle 1 exceeds 4/5×L or more. In this case, the point of intersection (b) is shifted in the direction of injection of the jet flow and therefore the pulverization object is brought into collision without being satisfactorily accelerated, resulting in poor pulverization efficiency. When the angle θ exceeds 60°, the distance of the point of intersection (b) from the jet-nozzle-5-side end of the pulverization nozzle 1 is 2/5×L or less. In this case, the pulverization object reaches the acceleration tube by a shorter distance and therefore the supply speed of the pulverization object is decreased. As a result, the acceleration speed of the injection nozzle may be also decreased.

Figure 3:
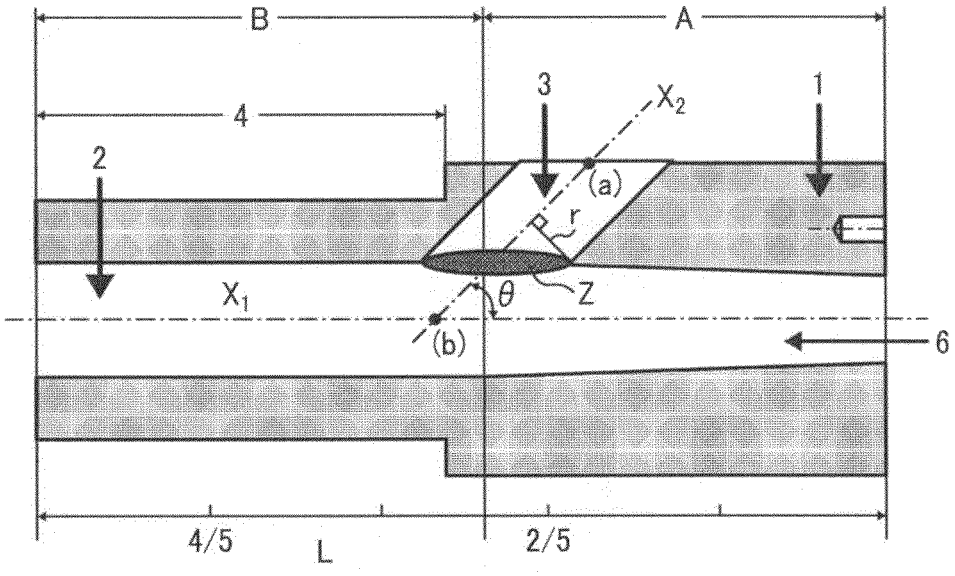
FIG. 3 is a schematic view of a pulverizer according to another embodiment.
Figure 4A:
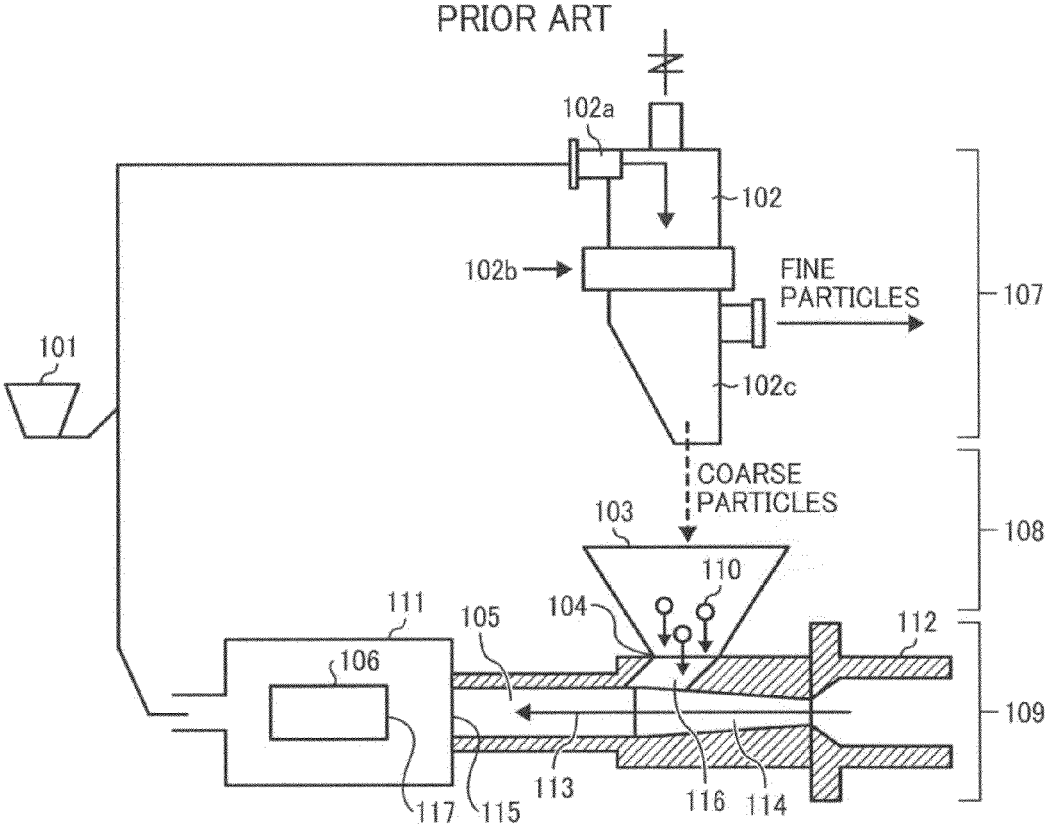
FIG. 4A PRIOR ART
FIGS. 4A and 4B, 5, 6, and 7A to 7D are schematic views of prior arts.
Figure 4B:
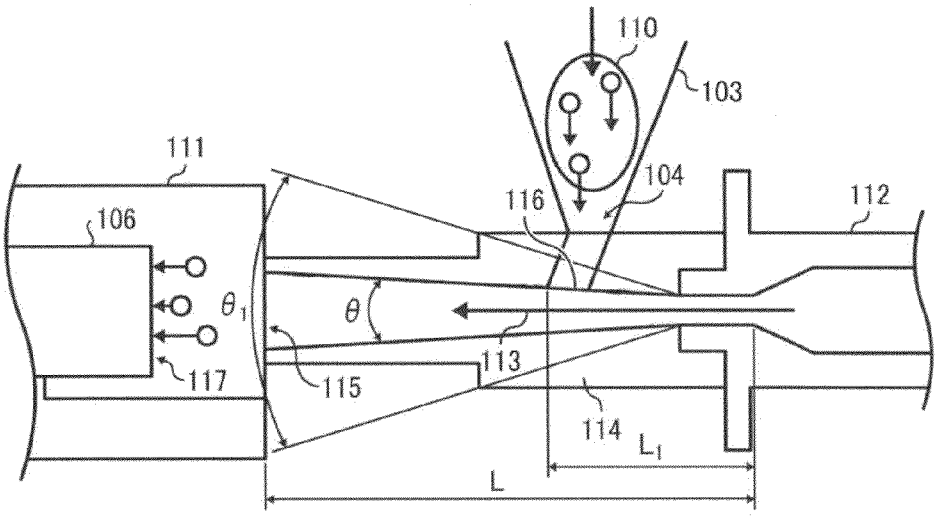
FIG. 4B PRIOR ART
Figure 5:
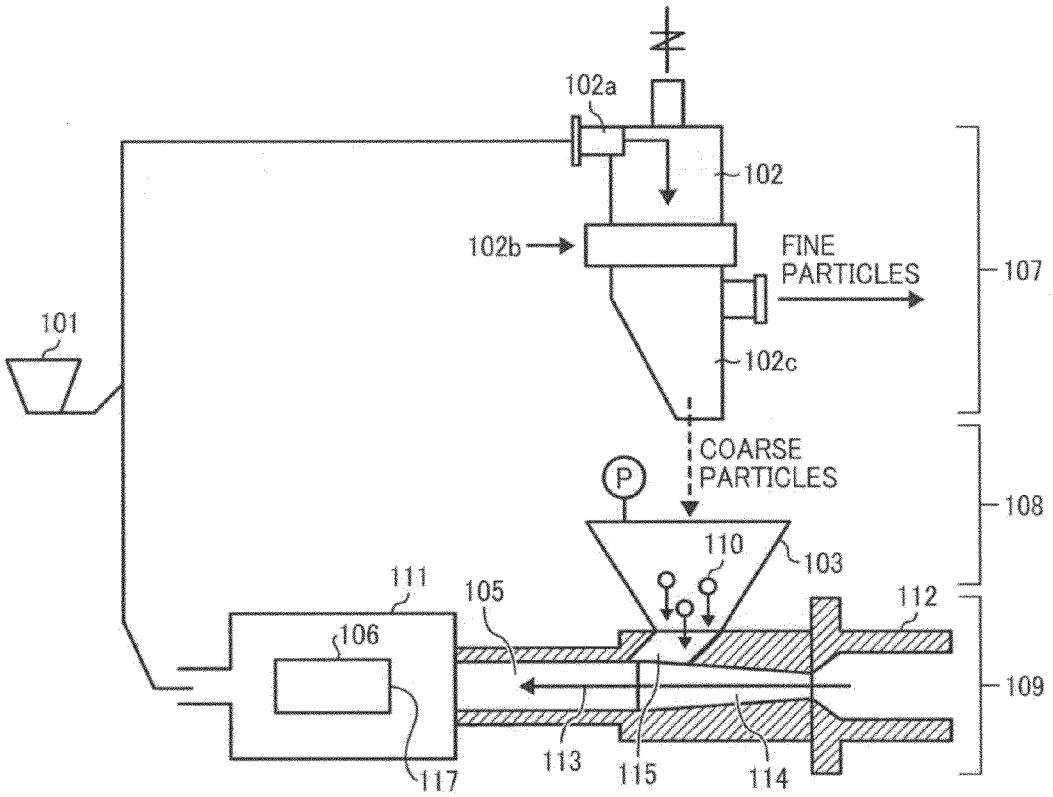
FIG. 5 PRIOR ART
Figure 6:
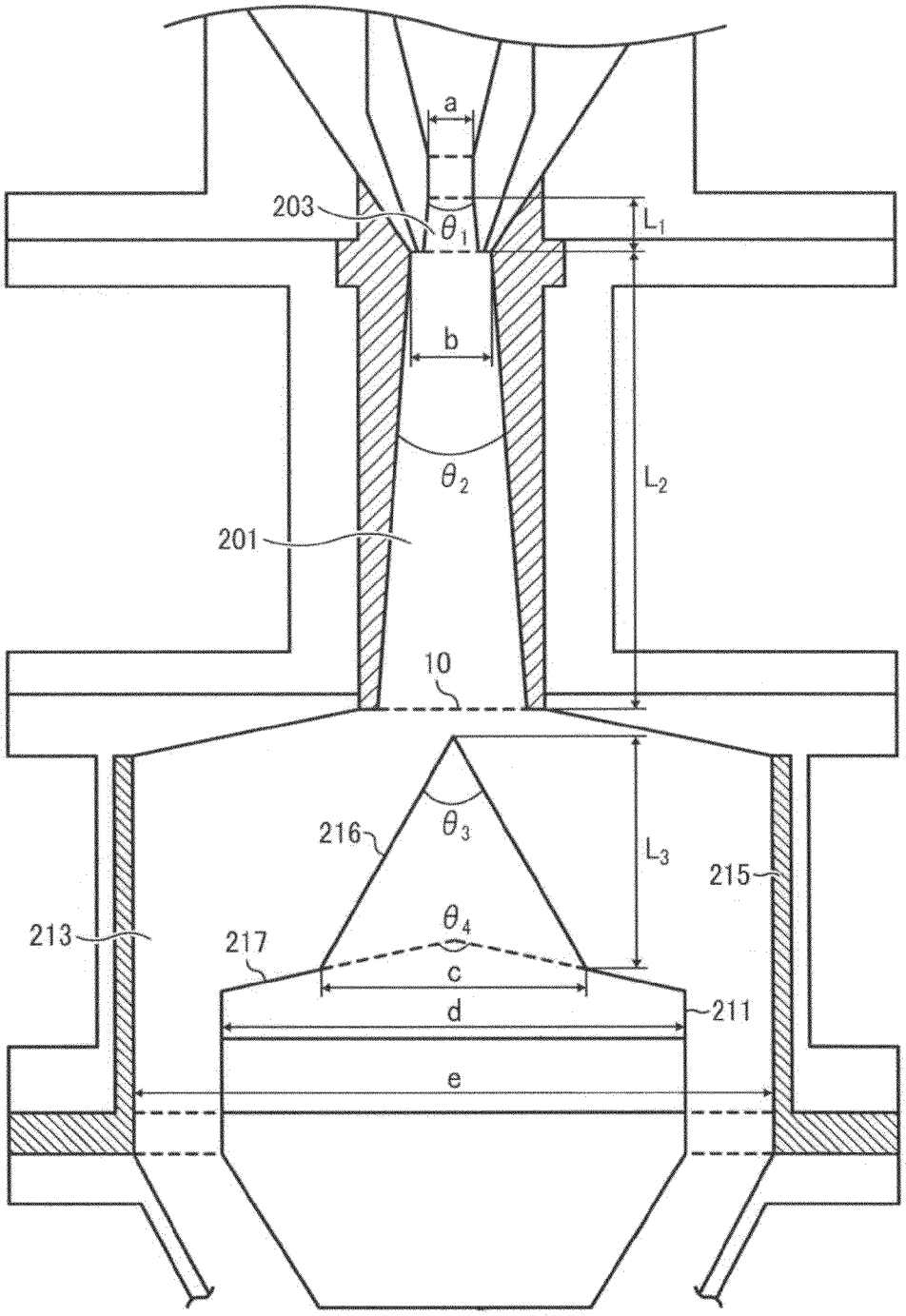
FIG. 6 PRIOR ART
Figure 7A:
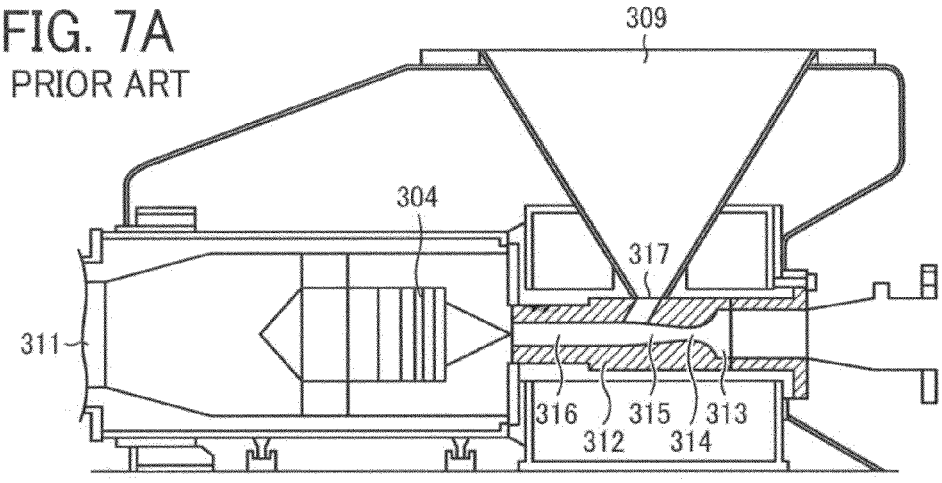
FIG. 7A PRIOR ART
Figure 7B:
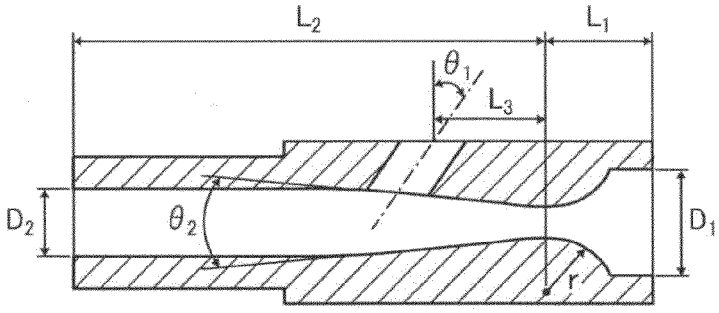
FIG. 7B PRIOR ART
Figure 7C:
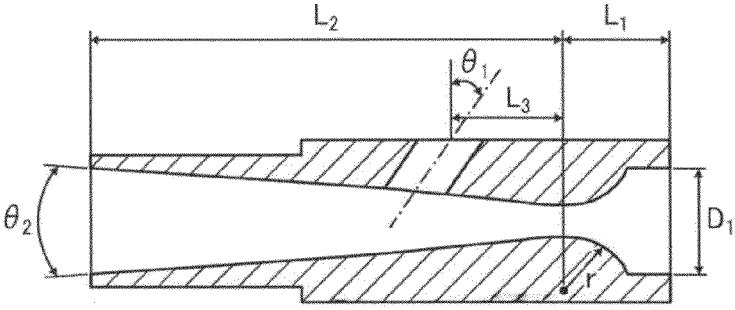
FIG. 7C PRIOR ART
Figure 7D:
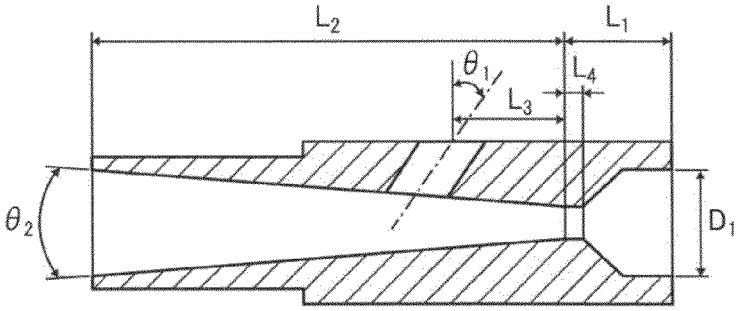
FIG. 7D PRIOR ART

FIG. 3 is a schematic view of a pulverizer according to another embodiment. In this embodiment, a cross-sectional area Z of the supply aperture 3 satisfies an inequation $1.1 \leq Z < 1.8$. When the above inequation is satisfied, a greater amount of pulverization object can be supplied to the pulverization nozzle while the acceleration speed is kept constant. When the cross-sectional area Z is less than 1.1, the pulverizing ability is lowered because the ability of supplying pulverization object to the pulverization nozzle is lowered and thereby the hopper is clogged with the pulverization object. When the cross-sectional area Z exceeds 1.8, the supply aperture extends beyond the diameter of the acceleration tube, which results in lowering of the acceleration speed.

The cross-sectional area Z is determined from the following formula.

$$Z=(\pi r^2)/\cos(90°-\theta)$$

wherein r represents a perpendicular line drawn from an edge of the supply aperture 3 toward the central axis X2 of the supply aperture 3.

According to an embodiment, the pulverization nozzle 1 is comprised of a metal. Metals are relatively easy to process, repair, and maintain, and have great strength.

According to an embodiment, the source pressure for generating the jet flow 6 is within a range from 0.4 to 0.7 MPa. When the source pressure is less than 0.4 MPa, the jet flow may not be sufficiently accelerated, resulting in poor pulverization ability. When the source pressure exceeds 0.7 MPa, the ejector effect may disappear and the pulverization object may be brought into collision with the collision member without sufficient acceleration, resulting in poor pulverization ability.

According to an embodiment, the pulverization object to be supplied from the supply aperture 3 of the pulverization nozzle 1 has a weight average particle diameter of 4 μm or more. When the weight average particle diameter is less than 4 μm, the pulverization object cannot be sufficiently supplied because the bulk density thereof is too small. According to an embodiment, the pulverizer is used in combination with a classifier for producing toner.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The pulverizer illustrated in FIG. 1 has the acceleration tube 2 within which the pulverization object 9 supplied through the supply aperture 3 is transported and accelerated by the jet flow 6; and the collision member 8 to pulverize the pulverization object 9 injected from the acceleration tube 2 into the pulverization chamber 7 by a collision force. The pulverization object 9 is pulverized with a high degree of efficiency because the supply amount can be improved without decreasing the acceleration speed of the jet flow 6. The pulverization product is then classified into coarse particles and fine particles in the classifier 11. The coarse particles are subjected to the pulverization again.

Example 1

Melt and knead a mixture of 75% of a polyester resin, 10% of a styrene-acrylic copolymer resin, and 15% of a carbon black by a roll mill. Cool and solidify the kneaded product. Coarsely pulverize the solidified product by a hammer mill and further pulverize it by the apparatus illustrated in FIGS. 1 and 2 equipped with a straight nozzle with an angle θ of 45°, a point of intersection (b) at a length of 2.64/5×L, and a cross-sectional area Z of 1.6, at a pulverization air pressure of 0.6 MPa. As a result, a pulverization product comprising 90% by number of fine particles having a weight average particle diameter of from 4.6 to 5 μm and 1.8% by weight of coarse particles having a weight average particle diameter of 8 μm or more is obtained in an amount of 35 kg per hour. The particle diameter is measured by a MULTISIZER (from Beckman Coulter, Inc.).

Example 2

Repeat the procedure in Example 1 except for replacing the apparatus with another apparatus equipped with a straight nozzle with an angle θ of 55°, a point of intersection (b) at a length of 2.37/5×L, and a cross-sectional area Z of 1.4. As a result, a pulverization product comprising 90% by number of fine particles having a weight average particle diameter of from 4.6 to 5 μm and 1.8% by weight of coarse particles having a weight average particle diameter of 8 μm or more is obtained in an amount of 38 kg per hour.

Example 3

Repeat the procedure in Example 1 except for replacing the apparatus with another apparatus equipped with a straight nozzle with an angle θ of 45°, a point of intersection (b) at a length of 3.02/5×L, and a cross-sectional area Z of 1.6. As a result, a pulverization product comprising 90% by number of fine particles having a weight average particle diameter of from 4.6 to 5 μm and 1.8% by weight of coarse particles having a weight average particle diameter of 8 μm or more is obtained in an amount of 30 kg per hour.

Comparative Example 1

Repeat the procedure in Example 1 except for replacing the apparatus with another apparatus equipped with a straight nozzle with an angle θ of 35°, a point of intersection (b) at a length of 2.64/5×L, and a cross-sectional area Z of 1.8. As a result, a pulverization product comprising 90% by number of fine particles having a weight average particle diameter of from 4.6 to 5 μm and 1.8% by weight of coarse particles having a weight average particle diameter of 8 μm or more is obtained in an amount of 41 kg per hour.

Comparative Example 2

Repeat the procedure in Example 1 except for replacing the apparatus with another apparatus equipped with a straight nozzle with an angle θ of 60°, a point of intersection (b) at a length of 2.26/5×L, and a cross-sectional area Z of 1.2. As a result, a pulverization product comprising 90% by number of fine particles having a weight average particle diameter of from 4.6 to 5 μm and 1.8% by weight of coarse particles having a weight average particle diameter of 8 μm or more is obtained in an amount of 25 kg per hour.

Comparative Example 3

Repeat the procedure in Example 1 except for replacing the apparatus with another apparatus equipped with a straight nozzle with an angle θ of 70°, a point of intersection (b) at a length of 1.98/5×L, and a cross-sectional area Z of 1.1. As a result, a pulverization product comprising 90% by number of fine particles having a weight average particle diameter of from 4.6 to 5 μm and 1.8% by weight of coarse particles having a weight average particle diameter of 8 μm or more is obtained in an amount of 23 kg per hour, with 10 kg of the pulverization product being clogged within the hopper.

Comparative Example 4

Repeat the procedure in Example 1 except for replacing the apparatus with another apparatus equipped with a straight nozzle with an angle θ of 70°, a point of intersection (b) at a length of 1/5×1, and a cross-sectional area Z of 1.0. As a result, a pulverization product comprising 90% by number of fine particles having a weight average particle diameter of from 4.6 to 5 μm and 1.8% by weight of coarse particles having a weight average particle diameter of 8 μm or more is obtained in an amount of 18 kg per hour, with 16 kg of the pulverization product being clogged within the hopper. The above results are summarized in Table 1.

TABLE 1

| | Example 1 | Example 2 | Example 3 | Comparative Example 1 | Comparative Example 2 | Comparative Example 3 | Comparative Example 4 |
|---|---|---|---|---|---|---|---|
| θ | 45 | 55 | 45 | 35 | 60 | 70 | 70 |
| L | 2.64/5 | 2.37/5 | 3.02/5 | 2.64/5 | 2.26/5 | 2.06/5 | 1.98/5 |
| Z | 1.6 | 1.4 | 1.6 | 1.8 | 1.2 | 1.1 | 1.0 |
| a | 1.7/5 | 1.7/5 | 1.7/5 | 1.7/5 | 1.7/5 | 1.7/5 | 1.7/5 |
| Shape of Nozzle | Straight | Straight | Straight | Straight | Straight | Straight | Straight |
| Yield Amount (kg/h) | 35 | 38 | 41 | 30 | 25 | 23 | 18 |

According to an embodiment, by changing the angle θ, the position of the point of intersection (b) can be changed such that the supply quantity and pulverization capacity are improved. When the angle θ, the position of the center of the supply aperture (a), and the point of intersection (b) are set as described above, a pulverization object can be constantly supplied to a jet flow while the acceleration speed of the jet flow is kept constant, which results in improvement in pulverization capacity and yield. The supply quantity can be controlled depending on the properties of the pulverization object, which is advantageous in terms of production efficiency and cost. The pulverization product may comprise small-sized particles which can be used as a toner for forming images with high quality.

When the cross-sectional area Z of the supply aperture satisfies the inequation $1.1 \leq Z < 1.8$, a greater amount of pulverization object can be supplied to the pulverization nozzle while the acceleration speed is kept constant. Owing to the straight tube part of the acceleration tube that is parallel to the central axis of the pulverization nozzle, the pulverization object is kept being accelerated constantly and pulverization capacity and yield are improved, which is advantageous in terms of production efficiency and cost. When the pulverization nozzle is comprised of materials such as SUS303 or SUS304, which are easy to process and low in cost, the pulverization nozzle is prevented from being damaged and thus the pulverization ability is kept constant for an extended period of time. When the source pressure for generating the jet flow is within a range from 0.4 to 0.7 MPa, fine particles with a desired particle size are obtained with a high degree of efficiency.

Additional modifications and variations in accordance with further embodiments of the present invention are possible in light of the above teachings. It is therefore to be understood that within the scope of the appended claims the invention may be practiced other than as specifically described herein.

What is claimed is:

1. A pulverizer, comprising:

a pulverization chamber;

a jet nozzle adapted to generate a jet flow toward the pulverization chamber;

a pulverization nozzle including:

an acceleration tube including:

an acceleration part A that includes a first part A end and a second part A end that is positioned opposite the first part A end, the first part A end of the acceleration part A being connected to a front end of the jet nozzle, a cross-sectional area of the acceleration part A being gradually enlarged from said first part A end toward the second part A end, the cross-sectional area being perpendicular to a central axis of the acceleration tube; and an acceleration part B that includes a first part B end and a second part B end that is positioned opposite the first part B end, the first part B end of the acceleration part B being connected to the second part A end and the second part B end being opened to the pulverization chamber, the cross-sectional area of the acceleration part B being constant from the first part B end to the second part B end that is opened to the pulverization chamber; and a supply aperture being opened to the acceleration tube to supply a pulverization object to the jet flow; and a collision member being disposed within the pulverization chamber, the collision member having a pulverization surface, the pulverization surface facing the pulverization nozzle so that the pulverization object conveyed by the jet flow directly collides with the pulverization surface to be finely pulverized, wherein a center (a) of the supply aperture is positioned within the acceleration part A, wherein a point of intersection (b) where central axes of the acceleration tube and the supply aperture intersect is positioned within the acceleration part B, and wherein an angle θ formed between the central axes of the acceleration tube and the supply aperture satisfies an inequation $30° \leq \theta < 60°$.

2. The pulverizer according to claim 1, wherein the point of intersection (b) is positioned between two points at distances of $2/5 \times L$ and $4/5 \times L$ from a jet-nozzle-side end of the pulverization nozzle, wherein L represents a length of the pulverization nozzle.

3. The pulverizer according to claim 1, wherein the center (a) of the supply aperture is positioned between two points at distances of $1/5 \times L$ and $2/5 \times L$ from a jet-nozzle-side end of the pulverization nozzle, wherein L represents a length of the pulverization nozzle.

4. The pulverizer according to claim 1, wherein a cross-sectional area Z of the supply aperture satisfies an inequation $1.1 \leq Z < 1.8$.

5. The pulverizer according to claim 1, wherein the pulverization nozzle is comprised of a metal.

6. The pulverizer according to claim 1, wherein the jet flow is generated with a source pressure of from 0.4 to 0.7 MPa.

7. The pulverizer according to claim 1, wherein the pulverization object has a weight average particle diameter of 4 μm or more.

* * * * *